US006536359B2

(12) United States Patent
Liu

(10) Patent No.: US 6,536,359 B2
(45) Date of Patent: Mar. 25, 2003

(54) FASTENING STRUCTURE FOR TABLE TOP AND LEG FRAME

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/903,512

(22) Filed: Jul. 13, 2001

(65) Prior Publication Data

US 2003/0010262 A1 Jan. 16, 2003

(51) Int. Cl.[7] ..... A47B 3/02
(52) U.S. Cl. ..... 108/118; 108/157.16
(58) Field of Search ..... 108/115, 118, 108/119, 153.1, 157.1, 157.18, 157.16, 129, 130, 132; 248/188

(56) References Cited

U.S. PATENT DOCUMENTS 1,835,661 A * 12/1931 Marquardt
4,064,815 A * 12/1977 Baum
4,686,910 A * 8/1987 Skjerseth
5,509,360 A * 4/1996 Chiu
6,158,361 A * 12/2000 Zheng et al.

* cited by examiner

*Primary Examiner*—Jose V. Chen
(74) *Attorney, Agent, or Firm*—Bacon & Thomas, PLLC

(57) ABSTRACT

An improved fastening structure for fastening a table top (1) and a leg frame (2) includes an anchor element (11) fixedly attached to the table top (1), and a displacement element (22) coupled to the leg frame (2) and movable thereon for engaging with the anchor element (11) through a fastener (3) such that the table top (1) is detachable from the leg frame (2) to form a smaller size to facilitate storing and transportation.

3 Claims, 5 Drawing Sheets

FASTENING STRUCTURE FOR TABLE TOP AND LEG FRAME

BACKGROUND OF THE INVENTION

The present invention relates to an improved fastening structure for a table top and leg frame and particularly a fastening structure that is engageable with the table top and leg frame when in use and detachable from the table top and leg frame to reduce the size to facilitate storing and transportation.

A conventional folding table as shown in FIG. 1 usually has two pivotal leg brackets fastened to the bottom side of the table top. The two leg brackets may be folded and collapsed to lean on the table top to make the table become a vertical and folding state.

While the construction set forth above can reduce the total size of the table at the folding state, the leg brackets are fixedly fastened to the table top, and after folding, the supporting legs of the leg brackets extend outwards from the peripheral rim of the table top for a substantial distance. It does not save much useful space and has limited space saving effect. Therefore it is still not a desirable design for the producers and consumers. On the other hand, there are tables which have detachable leg brackets that may be separated from the table top. While they may save the folding space, they do not have proper fastening structure between the table top and leg brackets. When in use, the table top is merely rested and straddled over the leg brackets. The table top does not have secured support and tends to wobble or tumble under external forces. It has safety concern.

SUMMARY OF THE INVENTION

The primary object of the invention is to resolve the foregoing disadvantages by providing a fastening structure to engage the table top with the leg frame such that the leg frame may be detached and completely separated from the table top when not in use for saving space and greatly reducing the total size of the table. The fastening structure also allows the table top to engage securely with the leg frame and distribute loading evenly to four ends to enable the table standing steadily and firmly on the ground.

To attain the foregoing object, the fastening structure of the present invention includes an anchor element fixedly attached to the table top and a displacement element coupling to the leg frame and movable thereon and is engageable with the anchor element through a fastener, thereby the table top and leg frame may be disassembled and assembled easily to a smaller size for storing and transportation.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
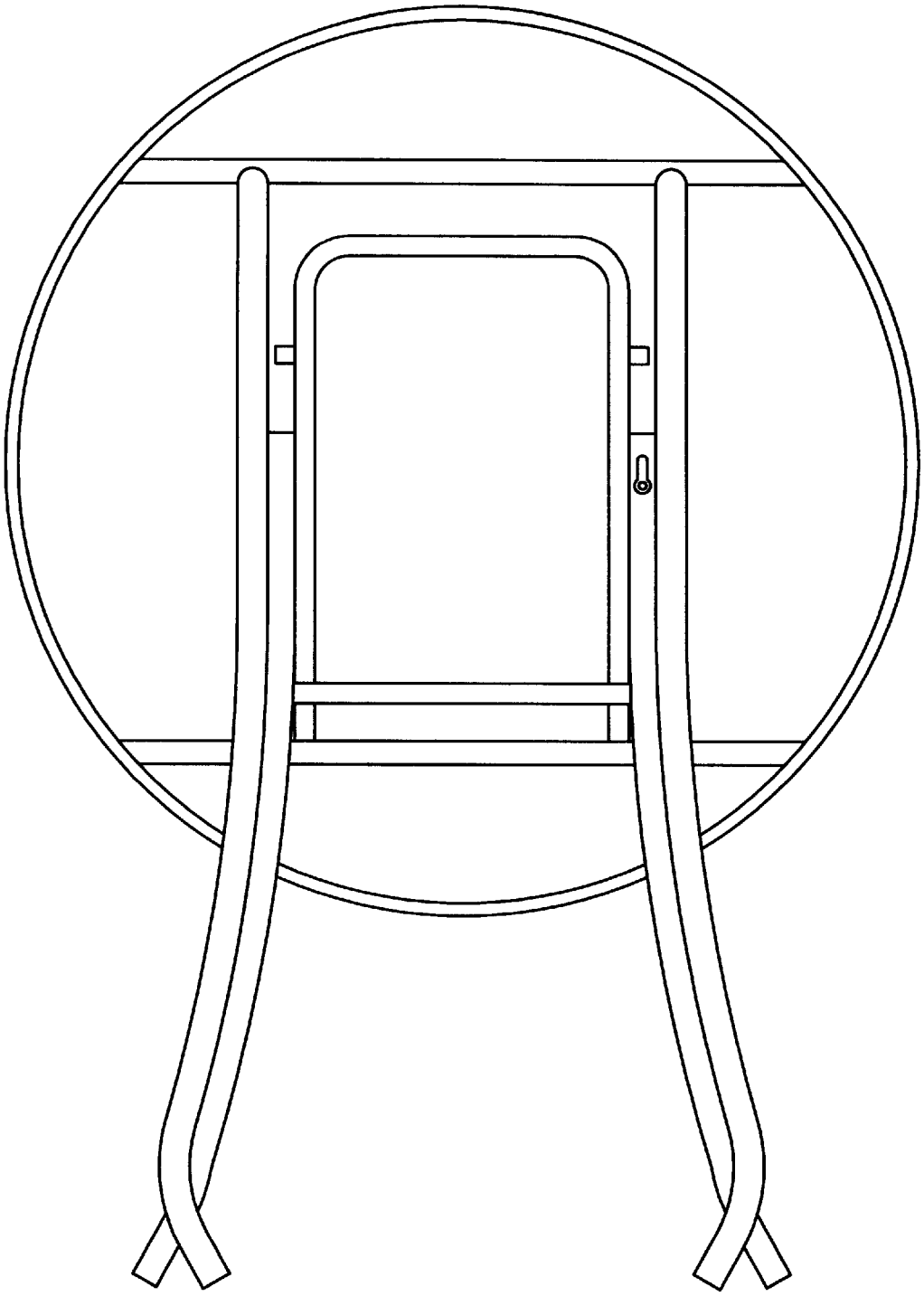
Fig.1 PRIOR ART
FIG. 1 is a schematic view of a conventional folding table.
Figure 2:
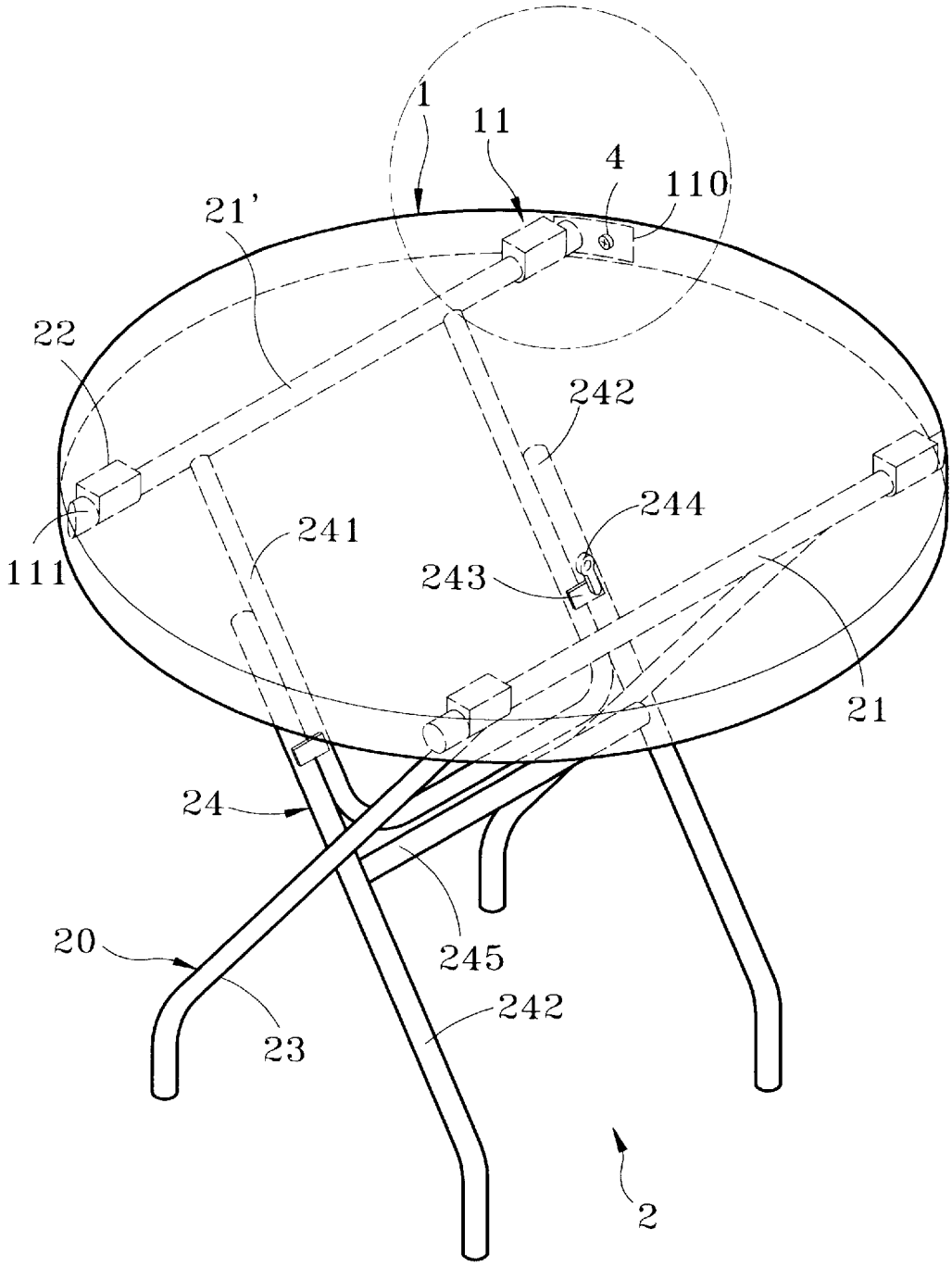
FIG. 2 is a perspective view of the invention.
Figure 3:
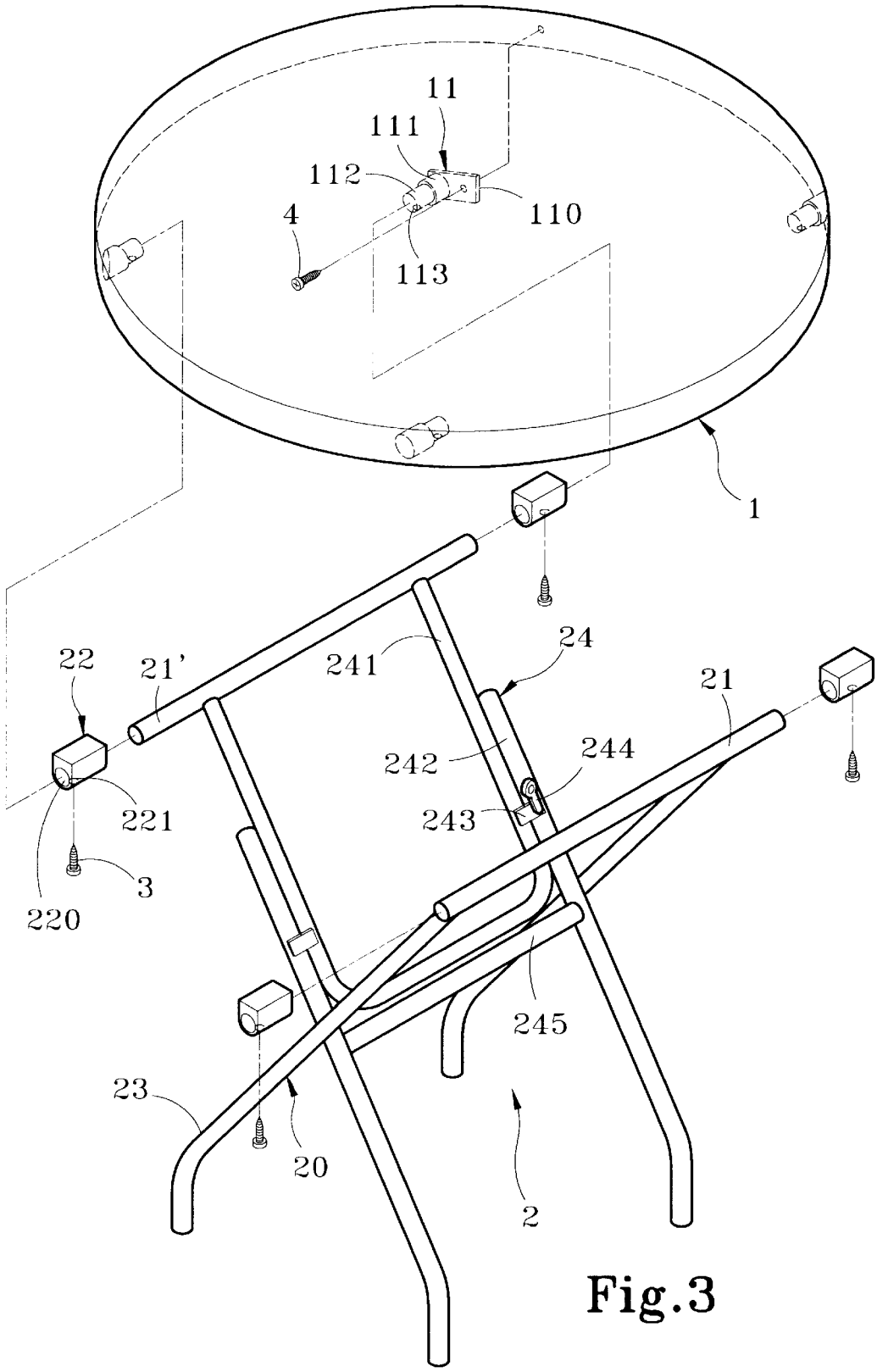
FIG. 3 is an exploded view of the invention.

Referring to FIGS. 2 and 3, the fastening structure of the invention is for engaging a table top 1 with a leg frame 2.

The fastening structure includes an anchor element 11 fixedly attached to the table top 1 and a displacement element 22 coupled to the leg frame 2 and movable thereon for engaging with the anchor element 11 through a fastener 3. The structure thus constructed allows the table top 1 and leg frame 2 be disassembled and assembled easily to a smaller size to facilitate storing and transportation.

The leg frame 2 includes two main supports 20 and 24 which are pivotally engaged with each other. The first main support 20 has at least a first transverse bar 21 for supporting the table top 1 and two supporting bars 23 for soldering the transverse bar 21. In an embodiment of the invention, the second support 24 has a second transverse bar 21' soldered to a pivotal bracket 241 which is pivotally engaged with a supporting bracket 242. The supporting bracket 242 is pivotally engaged with the first main support 20 through one supporting bar 23 and has a transverse stretcher bar 245. The pivotal bracket 241 and supporting bracket 242 are joined at a juncture which has a stopping lug 243 and a harness element 244 located thereon to prevent the table top 1 from incidental collapsing or folding because of uneven force when the leg frame 2 is extended (method of folding the leg frame 2 and the construction thereof are known in the art, thus will be omitted here).

Figure 4B:
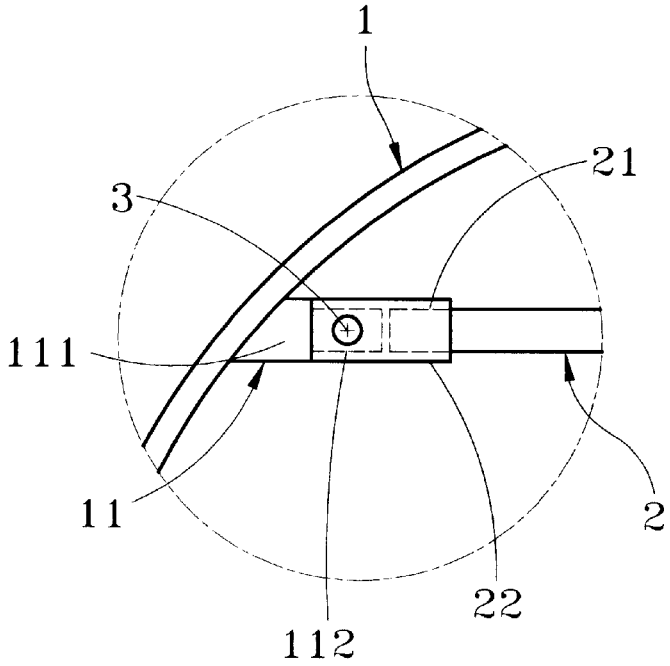
FIGS. 4A and 4B are fragmentary schematic views of the invention in use.
Figure 4A:
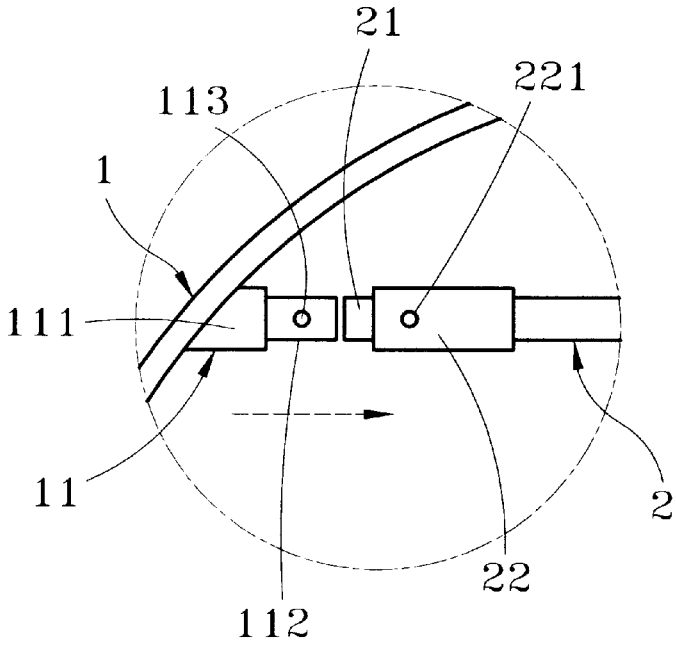

When assembling the table top 1 and the leg frame 2, first, fasten the body 110 of the anchor element 11 to the table top 1 through a fastener 4. As the body 110 is extended to form a constraint section 111 to limit the displacement of the displacement element 22, the angle between the body 110 and constraint section 111 is depended on the inner peripheral rim of the table top 1 where the body 110 is fastened to. The constraint section 111 is extended to form a stepped coupling section 112 for coupling with the displacement element 22. The length of the transverse bars 21 and 21' is no greater than the interval distance between the coupling sections 112 of two opposite anchor elements 11. The displacement 22 has a displacement trough 220 formed therein through two ends thereof. The displacement trough 220 has a diameter no less than the exterior diameters of the transverse bars 21, 21' and coupling section 112. The displacement element 22 is coupled with either end of the transverse bars 21 and 21' in such a way that the transverse bars 21 and 21' have respectively a free end exposed outside the displacement element 22 (as shown in FIG. 4A). When the leg frame 2 is extended for assembling to the table top, dispose the transverse bars 21 and 21' between two displacement elements 22 and move the displacements 22 to couple with the corresponding coupling sections 112 through the displacement troughs 220. The displacement element 22 has a first aperture 221 passing to the displacement trough 220, while the coupling section 112 has a second aperture 113 matching the first aperture 221. Hence the displacement element 22 may be fastened to the anchor element 11 by engaging a fastener 3 with the first aperture 221 and second aperture 113. Thereby the ends of the transverse bars 21 and 21' will be harnessed in the displacement trough 220 (as shown in FIG. 4B). When the four ends of the transverse bars 21 and 21' are fastened as described above, the table top 1 may be turned over to let the leg frame 2 standing firmly and steadily on the ground to support the stable top 1.

Figure 5:
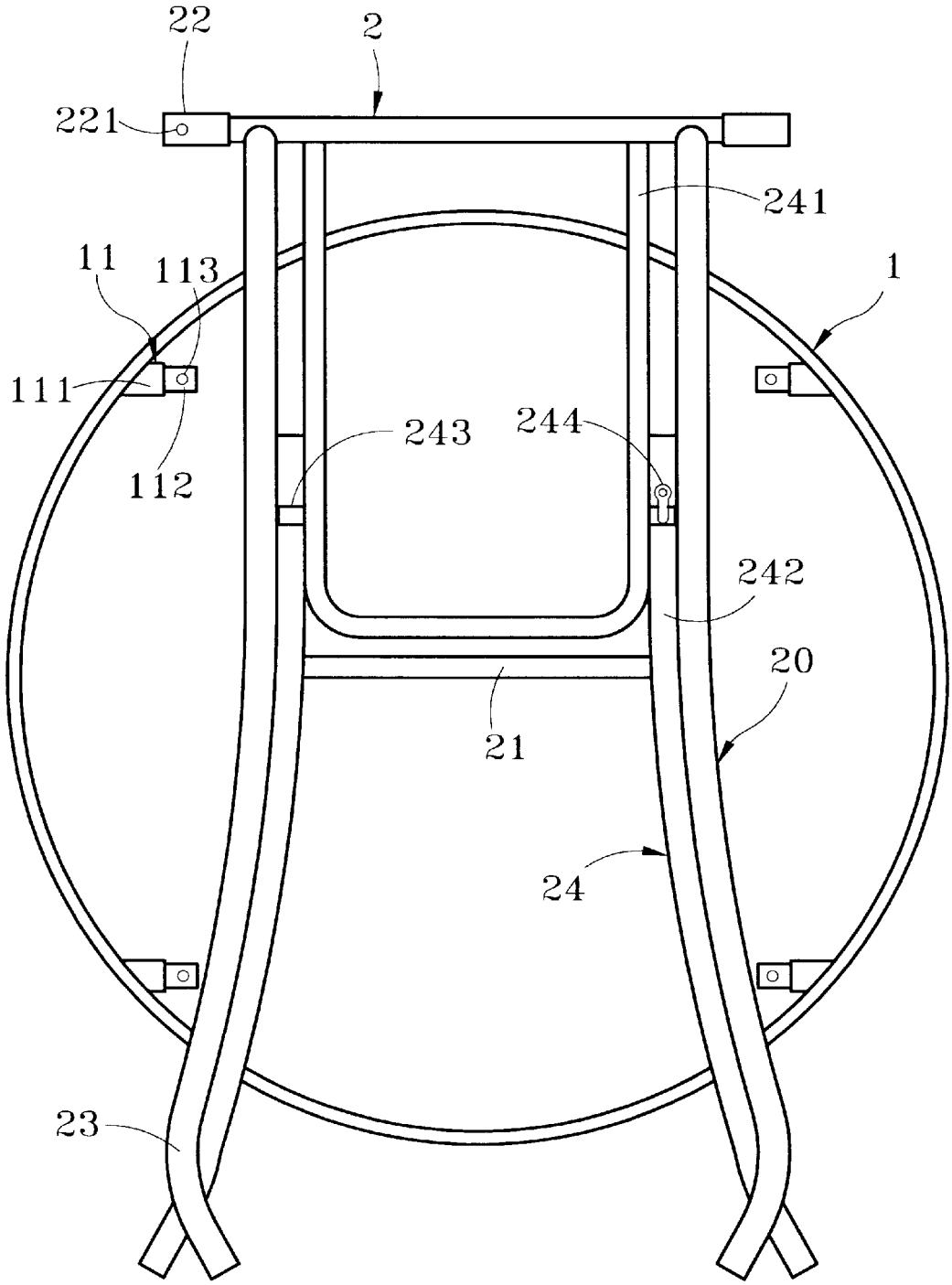
FIG. 5 is a schematic view of the invention, after detached and folded.

Referring to FIG. 5, the table top 1 and leg frame 2 may be disassembled by the reverse operations set forth above. After the table top 1 and leg frame 2 are detached and separated, the main supports 20 and 24 of the leg frame 2 may be folded. The leg frame 2 then may be disposed on one side of the table top 1 for packing and storing or transportation.

While the preferred embodiment of the invention has been set forth for the purpose of disclosure, modifications of the disclosed embodiment of the invention as well as other embodiment thereof may occur to those skilled in the art.

What is claimed is:

1. An improved fastening structure in combination with a table top (1), the fastening structure for fastening the table top (1) and a leg frame (2), comprising:

an anchor element (11) fixedly attached to the table top (1);

a displacement element (22) coupled to the leg frame (2) and movable thereon for engaging with the anchor element (11) through a fastener (3) such that the table top (1) is detachable from the leg frame (2) to form a smaller size to facilitate storing and transportation; and wherein the anchor element (11) includes a body (110) fixedly fastened to the table top (1) through a fastener (4), a constraint section (111) extending from the body (110) for limiting movement of the displacement element (22) and a coupling section (112) extending from the constraint section (111) in a stepped manner for coupling with the displacement element (22).

2. An improved fastening structure in combination with a table top (1), the fastening structure for fastening the table top (1) and a leg frame (2), comprising:

an anchor element (11) fixedly attached to the table top (1);

a displacement element (22) coupled to the leg frame (2) and movable thereon for engaging with the anchor element (11) through a fastener (3) such that the table top (1) is detachable from the leg frame (2) to form a smaller size to facilitate storing and transportation; and wherein the displacement element (22) has a displacement trough (220) formed therein through two ends thereof, the displacement trough (220) having an interior diameter no less than the exterior diameters of the transverse bars (21, 21') and the coupling section (112).

3. An improved fastening structure in combination with a table top (1), the fastening structure for fastening the table top (1) and a leg frame (2), comprising:

an anchor element (11) fixedly attached to the table top (1);

a displacement element (22) coupled to the leg frame (2) and movable thereon for engaging with the anchor element (11) through a fastener (3) such that the table top (1) is detachable from the leg frame (2) to form a smaller size to facilitate storing and transportation; and wherein the displacement element (22) has a first aperture (221) passing to the displacement trough (220), the coupling section (112) having a second aperture (113) matching and engageable with the first aperture (221) through a fastener (3).

* * * * *